US007794294B2

(12) United States Patent
Carlson

(10) Patent No.: US 7,794,294 B2
(45) Date of Patent: Sep. 14, 2010

(54) WATER INTAKE GRILL FOR PERSONAL WATERCRAFT

(76) Inventor: Morley Richard Carlson, 10313 Karston Ave., N.E., Albertville, MN (US) 55301

( * ) Notice: Subject to any disclaimer, the term of this patent is extended or adjusted under 35 U.S.C. 154(b) by 8 days.

(21) Appl. No.: 12/380,267

(22) Filed: Feb. 25, 2009

(65) Prior Publication Data

US 2009/0170383 A1 Jul. 2, 2009

Related U.S. Application Data

(63) Continuation-in-part of application No. 11/906,603, filed on Oct. 2, 2007, now Pat. No. 7,520,789.

(51) Int. Cl.
*B63H 11/01* (2006.01)

(52) U.S. Cl. ..... 440/46

(58) Field of Classification Search ..... 440/42, 440/46

See application file for complete search history.

(56) References Cited

U.S. PATENT DOCUMENTS

| | | | | |
|---|---|---|---|---|
| 3,040,695 | A | 6/1962 | Austin | |
| 3,147,733 | A | 9/1964 | Engel | |
| 3,253,567 | A | 5/1966 | Patton | |
| 4,027,617 | A | 6/1977 | Ikeda et al. | |
| 4,437,841 | A * | 3/1984 | Stallman | 440/42 |
| 5,096,373 | A | 3/1992 | Struve et al. | |
| 5,690,520 | A | 11/1997 | Rheault | |
| 5,779,508 | A | 7/1998 | Pettesch et al. | |
| 7,520,789 | B1 | 4/2009 | Carlson | |

OTHER PUBLICATIONS

R&D Aquavein & Worx Racing Maxiloader Intake Grates, Online Product Catalog Search at www.denniskirk.com, Sep. 1, 2009, (on pp. 2-4 of enclosed ref. R1).

(Continued)

*Primary Examiner*—Stephen Avila
(74) *Attorney, Agent, or Firm*—Michael A. Mochinski

(57) ABSTRACT

A water intake grill for attachment to a water intake port of a jet watercraft. The water intake grill comprising a plurality of elongate members situated in between and mounted to fore and aft mounts. The fore mount comprising a base having an angularly orientated bottom surface for receiving and attaching first ends of the elongate members and an angularly orientated top surface for optionally situating atop thereof a removable key element having an overall geometric structure substantially coinciding with the geometric configuration of a mount socket integral to a forward wall section of the water intake port. The aft mount comprising a horizontally positioned base having rearward and forward sections for optionally accepting and resting atop of each thereof at least one removable spacer and an angular edge for receiving and attaching second ends of the elongate members. Each elongate member comprising a teardrop geometric profile incorporating an outward bottom section having a general rounded appearance and a tapered top end having sides commencing from an apex and extending angularly outward therefrom toward the outward bottom section, a geometric profile of which effectively reduces the amount debris into the water intake port while allowing continued passage of water into the water intake port to yield sustained operating performance of the jet watercraft and maintain effective cooling of the combustion engine generally associated therewith.

20 Claims, 13 Drawing Sheets

OTHER PUBLICATIONS

R&D Aquavein & Solas Intake Grates, Online Product Catalog Search at www.denniskirk.com, Sep. 1, 2009, (on pp. 1-2 of enclosed ref. R2).

PWC Intake Grates for or by Yamaha, Solas, UMI Racing, Worx,and R&D Aquavein, Online Product Catalog Search at www.justatv.com, Sep. 1, 2009, (on pp. 1,4-7 of enclosed ref. R3.

* cited by examiner

WATER INTAKE GRILL FOR PERSONAL WATERCRAFT

CROSS-REFERENCE TO RELATED APPLICATIONS

This application is a continuation-in-part application of my prior application U.S. Ser. No. 11/906,603, filed Oct. 2, 2007, now U.S. Pat. No. 7,520,789 issued Apr. 21, 2009, entitled "Water Intake Grill for Personal Watercraft," the disclosures of which, including all attached documents, are incorporated herein by reference in their entirety for all purposes.

FIELD OF THE INVENTION

The present invention is directed to a water intake grill for attachment to a water intake port of a personal watercraft, namely a jet watercraft. More specifically the water intake grill effectively mitigates the entry of debris and foreign matter such as water grasses and moderately- to large-sized rock into the water intake port, sufficiently of which results in continued performance and a reduced occurrence of damage to the water jet propulsion system inherently included as part of the jet watercraft.

BACKGROUND OF THE INVENTION

The use of boats is a very popular recreational activity. The popularity of this recreational activity has led to a wide variety of boat designs, including by way of example, classic sailboats, boats specifically designed to improve the fishing experience, boats designed for speed and racing, and pontoon boats with a large flat deck designed to accommodate a number of individuals for socializing, eating, sunbathing, and swimming. Just as diverse as the number of boat designs is the number of options for propelling a boat through the water.

Sails capture the wind for propulsion and internal combustion engines turn one or more propellers to swiftly propel a boat through the water. Internal combustion engine configurations include outboard motors that are primarily attached to an exterior portion of a hull or transom of a boat with a propeller extending downwardly into the water for propulsion. Conversely, internal combustion engines are preferentially located within the confines of the boat where a shaft generally extends through the length of the boat's hull and exits through a watertight seal to permit connection to and rotate an external propeller to power the boat through the water. Placing an internal combustion engine inside a boat also lends to another form of boat design and propulsion possible: a jet boat that incorporates features of a water jet pump.

A jet boat is primarily propelled along the surface of a body of water such as a lake or ocean via a water jet propulsion system. Powerful motors draw in volumes of water from the lake or ocean and expel a stream of water from the stern of the boat with such extreme force that it swiftly propels the jet boat through the water. This water jet design in particular requires large volumes of water to be drawn into and expelled from a water jet. The powerful motors that are used in this configuration create a tremendous amount of suction to draw the large amounts of water into the system necessary to propel these boats at the desired operating speeds.

A jet boat of the type known in the art eliminates the presence of an external propeller, which offers a significant advantage to boaters. By reducing the risk of injury from a propeller, water jet propulsion has enabled greater human interaction with the boat and the water. This design element has made a number of smaller more unique boats possible, primarily those that can be operated by a lone operator. Many examples of these personal watercrafts exist as their popularity has expanded over past years.

For instance, personal watercraft manufacturers have adapted jet boat water jet propulsion technology into a unique boat design and application. Where a jet boat would accommodate one or typically two or more riders who enter and are seated in the jet boat, personal watercraft are smaller and more commonly designed for one operator to straddle the watercraft similar to a snowmobile or motorcycle. In another variation, the design of the Jet Ski®, as pioneered and trademarked by the Kawasaki Corporation of Japan, simulates water skiing by riders of these vehicles, primarily allowing one to stand and operate a steering handle while the water jet propels a single hull ski under the rider's feet. These unique applications of water jet technology are significant because they allow use of personal watercraft in areas where one would not typically expect to travel with a larger jet boat. This design coupled with its unique propulsion system has greatly expanded the use of personal watercraft for leisure recreational activity, water rescue activity, and for competitive sporting activities. Smaller bodies of water where boats are less common are now home to the smaller more versatile personal watercraft. Personal watercrafts because of their small size are easier to launch into shallow water than conventional boats. Personal watercrafts are typically lighter and have smaller trailers than larger-sized boats, such that it is possible for a lone user to launch a personal watercraft for a day of water recreation. Their unique propulsion system is free of externally mounted motors and propellers, thus making it easier to launch and use personal watercraft in smaller bodies of water and in shallow water. Smaller bodies of water and shallow areas do, however, present unique challenges to personal watercraft use and operation.

Smaller bodies of water and shallow areas are common places where one can find an accumulation of natural and manmade debris such as rocks, trash, dead fish, algae, and weeds. By the nature of both how the water jet propulsion system of personal watercraft operates and where users of personal watercraft choose to use these vehicles, personal watercraft are prone to problems with natural and manmade debris. The powerful motors of these vehicles have an inadvertent tendency to draw in water simultaneously with that of the debris that may consequentially harm the water jet propulsion system. Debris can enter the water inlet port of a water jet propulsion system and block or restrict the flow of water through the water jet. Any sufficient blockage of water flow can decrease performance of a water jet and may prevent it from functioning in a proper manner. Debris such as rocks can break or damage vital operable components of the water jet system which may necessitate expensive repairs. Some water jet systems are designed to use water to not only propel the watercraft, but also to divert a portion of that water stream to cool the internal combustion engine.

Internal combustion engines that are not properly cooled will accelerate the breakdown of lubricating oils and cause premature engine wear, ultimately of which may render the vehicle inoperable. In other instances, excessive debris in the water jet propulsion system could cause the engine to perform poorly and operate at higher revolutions per minute stressing the engine parts thereby greatly reducing the overall operational life of the personal watercraft.

There have been numerous attempts in the art to solve the aforementioned problems, including the attachment of a screen to the intake port that is adaptably designed to prevent the entry of debris and like matter into the jet propulsion system, notably of the type described in U.S. Pat. No. 3,040,695 entitled "Intake Strainer." However, the nature of screen construction in and of itself may act as an impediment to water flow into water jet pump. In fact, a poorly designed screen may disrupt the laminar water flow characteristics along the boat's hull. Furthermore, a screen of this type may further create turbulent, air-entrained water mixtures that when fed into the water inlet port of the water jet pump may appreciably decrease the efficiency of the jet watercraft. Screens also have the disadvantage of becoming unduly obstructed by the presence of debris that may be inadvertently held for some time onto the surficial portion of the screen, as principally established by the powerful suction of the jet water pump.

To address the problem of clogged screens, the prior art offers numerous examples of screens with mechanical cleaning components such as that depicted in U.S. Pat. No. 3,253,567 entitled "Mechanism for Use in Conjunction with the Intake Opening of a Water Jet Propelled Vehicle." These devices are extremely complex and the additional moving parts make them susceptible to higher requirements of service and maintenance and ultimately breakage. More modern personal watercrafts incorporate an intake guard configured with a pair of extended finned members connected to mounts that adaptably fit atop the water inlet port, generally being perceived to be less complex than the screen designs noted herein. Compared to such complex screen designs, the intake guard has a lower cost of manufacture and can be easily installed in new and existing jet watercraft. While the intake guard inherently offers these distinct design advantages, it may be ineffective as functioning as a barrier to water-borne debris, particularly moderately-sized rocks that can be semi-permanently trapped within the extended finned members, and protecting the water jet pump and associated operable components from damage.

Without attempting to modify the existing two bar screen design noted above, other attempts are documented in the art to address the nature of a clogged screen, including a manual cleaning device described in U.S. Pat. No. 5,690,520 entitled "Weed Removal Apparatus for a Jet Pump Propelled Watercraft." This sort of manual cleaning device presents several challenges, including the requirement of transporting and stowing the device during nonuse and awkwardness of using the device to fully appreciate its stated utility. In fact, novice personal watercraft users many not recognize the appropriate time to use such a manual device, particularly during times of jet watercraft operation.

In other attempts to solve this problem, especially in areas where vine-like water weeds are present and pose a common problem, the screen may be configured to allow one to open and reach into the water inlet chamber and water jet to manually remove weeds. This type of inlet screen with opening capabilities is described in U.S. Pat. No. 4,027,617 entitled "Grating Apparatus for Protecting the Draft Port of a Water Jet Propulsion System." This type of device is described as having a plurality of moving parts and springs that may have a tendency to prematurely wear and fail over a period of time. Another significant problem with the opening inlet screen is that it presumes weeds will enter the system and does little to prevent weeds from entering the system. Other attempts noted in the art to solve this problem have sought to block weeds from entering the water jet pump, such as the device described in U.S. Pat. No. 5,779,508, entitled "Anti-clogging Water Jet Craft," wherein extra appendages are attached to the bottom of the watercraft to block debris and like matter. This extra appendage, however, complicates the process of launching and trailering personal watercraft and reduces the desirable attribute of operating personal watercraft in shallow water.

Further attempts are noted in the art, including the alteration of the screen as described in U.S. Pat. No. 3,147,733 entitled "Inlet Screen," wherein the tines of the screen are attached to only one end of the screen. This design relies on the vibration of the engine and water flow under the boat's hull to cause the debris to remove itself from the inlet screen. This design lacks durability as the tines by design may unduly vibrate as a result of being attached to only one end. Also, this design does not solve the problem of solid compact debris, notably large rocks, which can enter the end of the screen where the tines are not attached.

Accordingly, there remains a need for a jet watercraft intake grill comprising solid, single piece construction, particularly of which prevents water-borne debris from entering into the water jet pump, functions without rider intervention, provides for an improved condition of laminar water flow into the water intake port of the water jet pump, permits continued operation of the jet watercraft in shallow water without undue obtrusiveness, and furthers the ease of loading and unloading the personal watercraft into a body of water.

BRIEF SUMMARY OF THE INVENTION

In order to overcome the numerous drawbacks apparent in the prior art a water intake grill has been devised for adaptation and use with a jet watercraft of the type commonly known and available in the art to carry and transport one or more persons over a surface of a body of water.

It is an object of the present invention to provide a water intake grill that is sufficiently capable of mitigating the entry of water-borne debris such as suspended weeds and moderately- to large-sized rocks into a water jet inlet port of a jet watercraft.

It is another object of the present invention to provide a water intake grill that is easily manufactured as a solid, single piece to yield reliable, durable performance and lessen the overall cost of manufacture.

It is another object of the present invention to provide a water intake grill that effectively reduces costly repairs and operational downtime generally associated with a jet watercraft's factory-installed intake guard.

It is another object of the present invention to provide a water intake grill that improves the laminar water flow characteristics through the water jet inlet port and into the water jet pump of the jet watercraft to sustain its performance as configured and designed by the manufacturer.

It is another object of the present invention to provide a water intake grill that moderately improves fuel efficiency of a jet watercraft by means of sustaining adequate water flow into and through the water jet propulsion system.

It is another object of the present invention to provide a water intake grill that adaptably fits to a variety of jet watercrafts through usage of removable key elements and spacers suited to accommodate and correspond with the unique design configuration of the stock water jet inlet port.

It is yet another object of the present invention to provide a water intake grill which accomplishes the foregoing and other objects and advantages and which is economical, durable, and fully effective in performing its intended functions without unduly compromising the performance of the jet watercraft.

In accordance with the present invention, a water intake grill has been devised for easy installation and replacement of a factory-installed intake guard commonly associated with a water intake port of a stock jet watercraft, the water intake grill preferentially comprising a plurality of elongate member situated in between and attached to fore and aft mounts, the fore mount having a base with angularly orientated top and bottom surfaces and a removable key element optionally situated atop the angularly orientated top surface, the removable key element comprising top and bottom facing sides integrally connected by pitched sides to collectively form an overall geometric structure substantially coinciding with the geometric configuration of a mount socket integral to a forward wall section of the water intake port, the aft mount comprising a horizontally positioned base having a geometric structure substantially coinciding with the geometric configuration of a mount socket integral to a rearward wall section of the water intake port and rearward and forward sections each suited to optionally receive and rest atop thereof at least one removable spacer, the forward section comprising an elevated back edge with an angular edge integrally connected thereto for receiving and attaching second ends of the elongate members, each elongate member comprising a teardrop geometric profile incorporating an outward bottom section having a general rounded appearance and a tapered top end having sides commencing from an apex and extending angularly outward toward the outward bottom section, a geometric profile of which effectively reduces the amount of debris into the water intake port while allowing continued passage of water into the water intake port to yield sustained operating performance of the jet watercraft and maintain effective cooling of the combustion engine generally associated with the jet watercraft.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is considered to exemplify the principles of the present invention and is not intended to unduly limit the invention to the embodiments illustrated and presented herein. The present invention has particular utility as a device for minimizing the passage of debris and foreign matter of the type commonly resting on the bottom of and/or suspended in a body of water into a water intake port of a jet watercraft while simultaneously permitting the continuous passage of water into and through the water intake port of the jet watercraft to promote its effective operation as configured and designed by the manufacturer.

Figure 1:
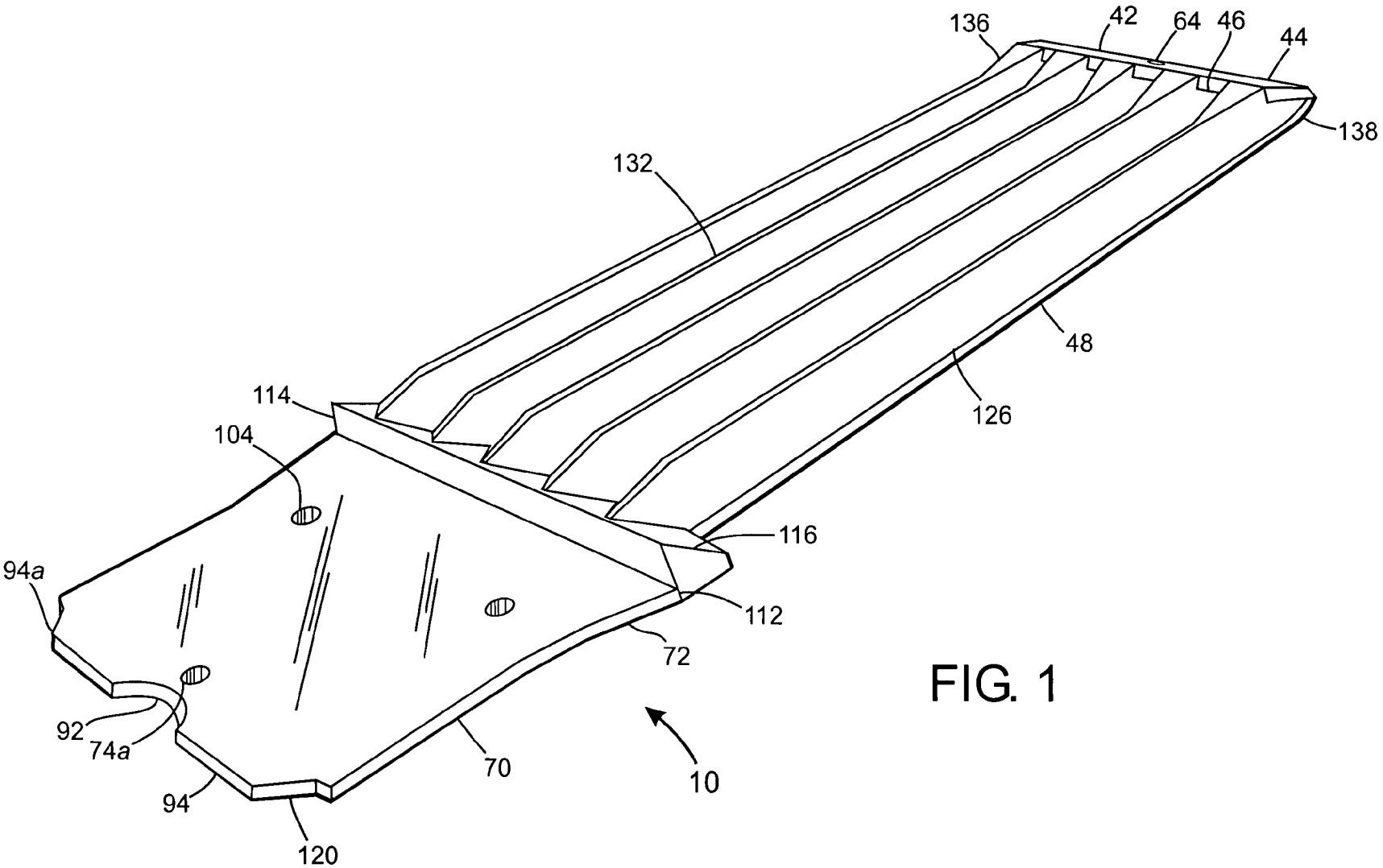
FIG. 1 is a perspective view of the preferred embodiment of the present invention illustrating a plurality of elongate members situated in between and connected to fore and aft mounts.
Figure 2:
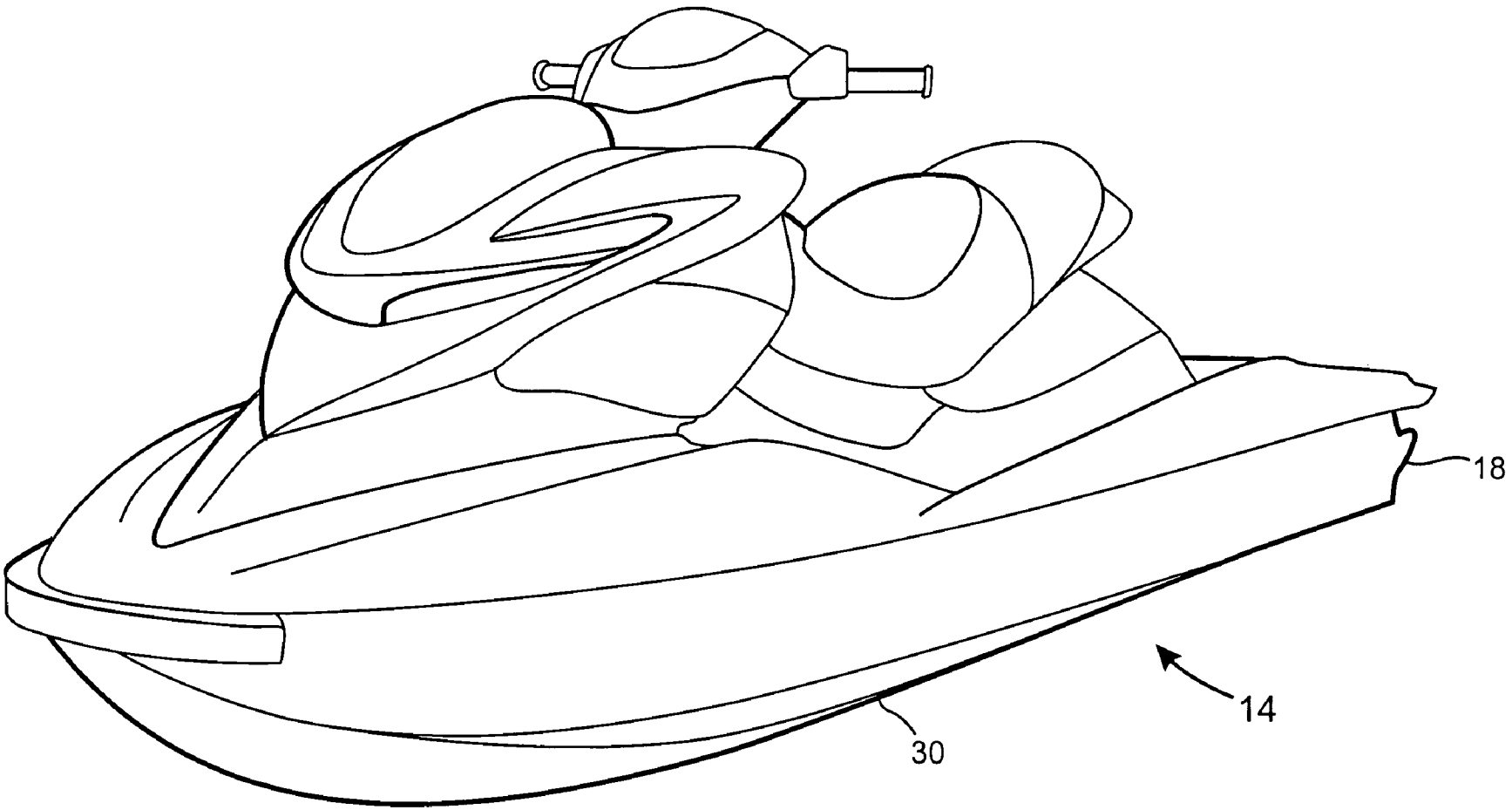
FIG. 2 is a perspective view of a jet watercraft of the type known and available in the art to carry and transport one or more persons over a surface of a body of water.
Figure 3:
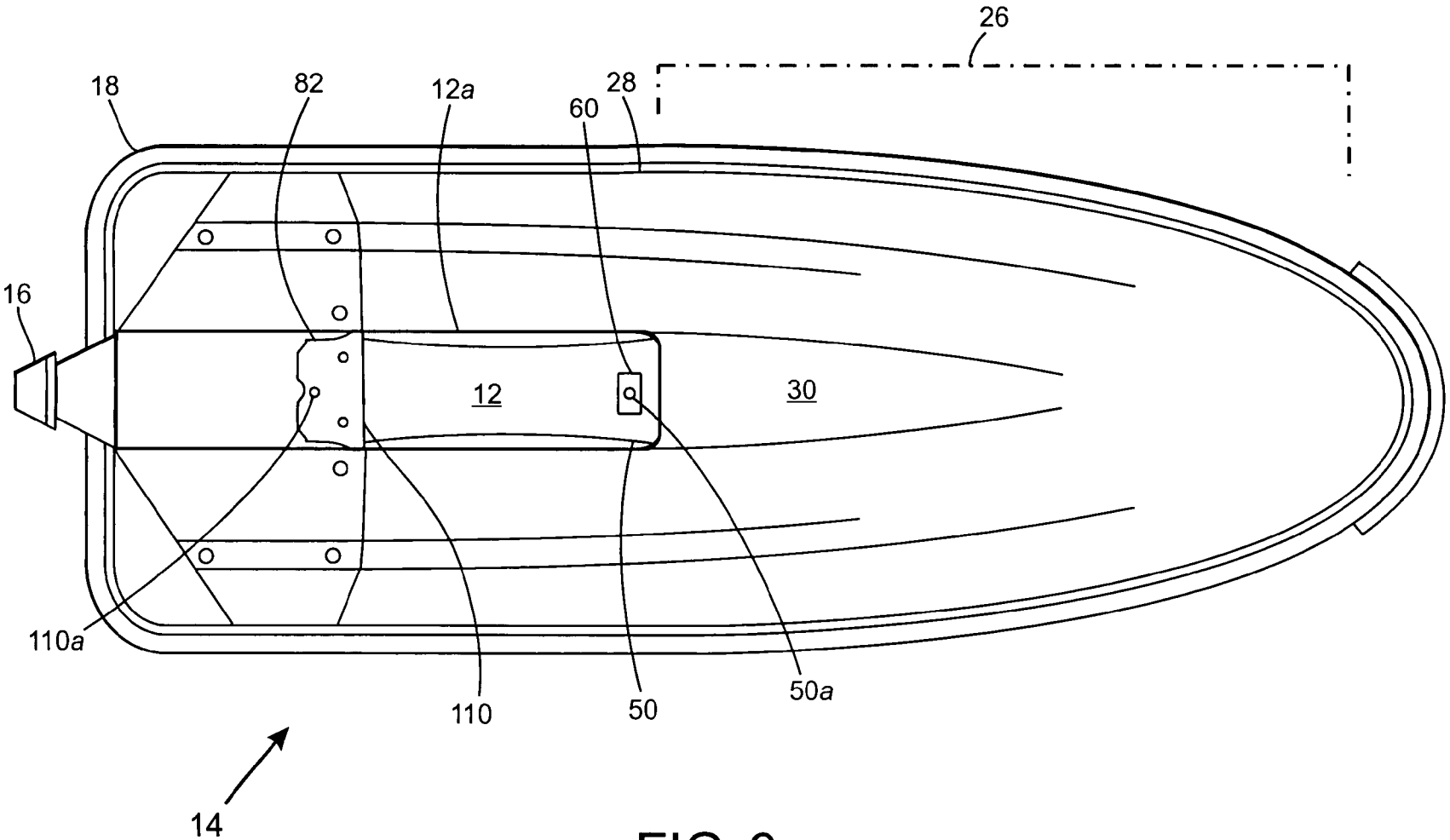
FIG. 3 is a bottom plan view of a hull of a jet watercraft having a water intake port for receiving water and a constriction nozzle located at rear side of the jet watercraft for forcibly propelling water outwardly therefrom.

Reference is now made to FIG. 1 of the drawings illustrating a water intake grill 10 for attachment to a water intake port 12 of a jet watercraft 14 of the type commonly known in the art to carry and transport one or more persons over a surface of a body of water. The jet watercraft, as depicted in FIGS. 2 and 3, generally includes means for drawing into the water intake port a predetermined volume of water and expelling the water forcibly outward from a constricting nozzle 16 located at a rear side 18 of the jet watercraft 14. In most jet watercraft configurations, notably of the type shown in FIG. 4, water drawing means typically comprises a mixed flow impeller 20 housed within a centralized casing 22 in hydraulic communication with the water intake port and constricting nozzle 16 and connected to a drive shaft 24 which is rotatably driven by an internal combustion engine (not shown) located near a front-to-mid sectional portion 26 of the jet watercraft, as shown by the bounded line in FIG. 3. The intake of water into and through the water intake port 12 may supplement cooling of the internal combustion engine via a plurality of open duct ways (not shown) in hydraulic communication with the centralized casing and internally housed and routed within an engine compartment of the jet watercraft 14 and/or solely within the configuration of the combustion engine. Other and more modern jet watercraft configurations may eliminate the open duct ways entirely and rely on most part on a closed cooling system (not shown) to eliminate any introduction of debris and like matter that may hamper effective cooling of the combustion engine. It is noted herein that the water intake grill 10 of the present invention is primarily directed and suited to both configurations described above, specifically being configured in the former to minimize the passing of debris and like foreign mater into the water intake port 12 and open duct ways that may rise to compromised performance or entire breakdown of the jet watercraft 14 due to inadequate cooling of the combustion engine and in the later and former to mitigate the passing of moderately-sized rocks through the water intake port and into the centralized casing 22 that may inadvertently strike and damage the mixed flow impeller 20 and associated operable components like the drive shaft 24 residing therewithin.

Figure 5:
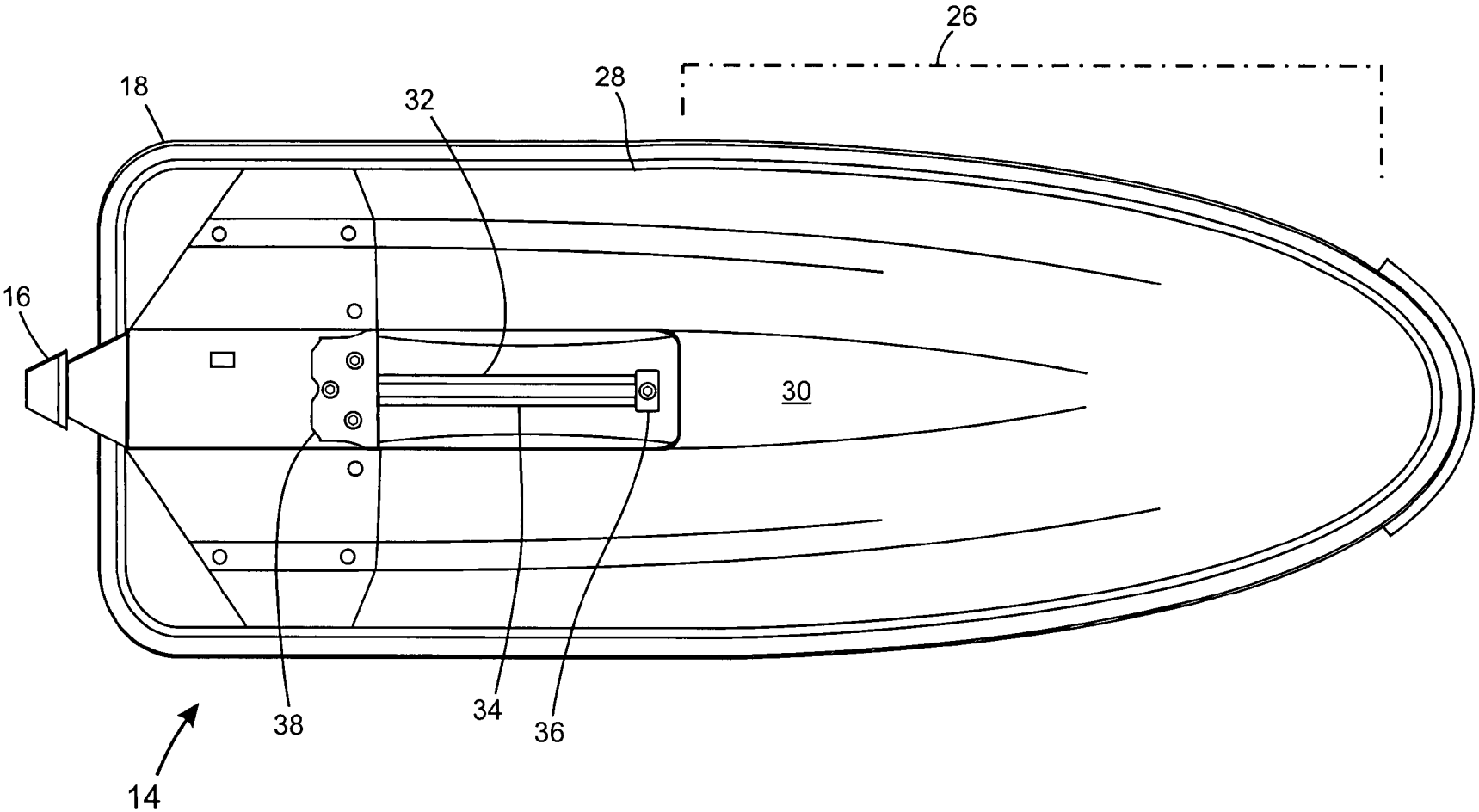
FIG. 5 (PRIOR ART)
FIG. 5 is a bottom plan view of a hull of a stock jet watercraft equipped with an intake guard of the type typically known in the art and mounted to a water intake port of the jet watercraft.
Figure 6:
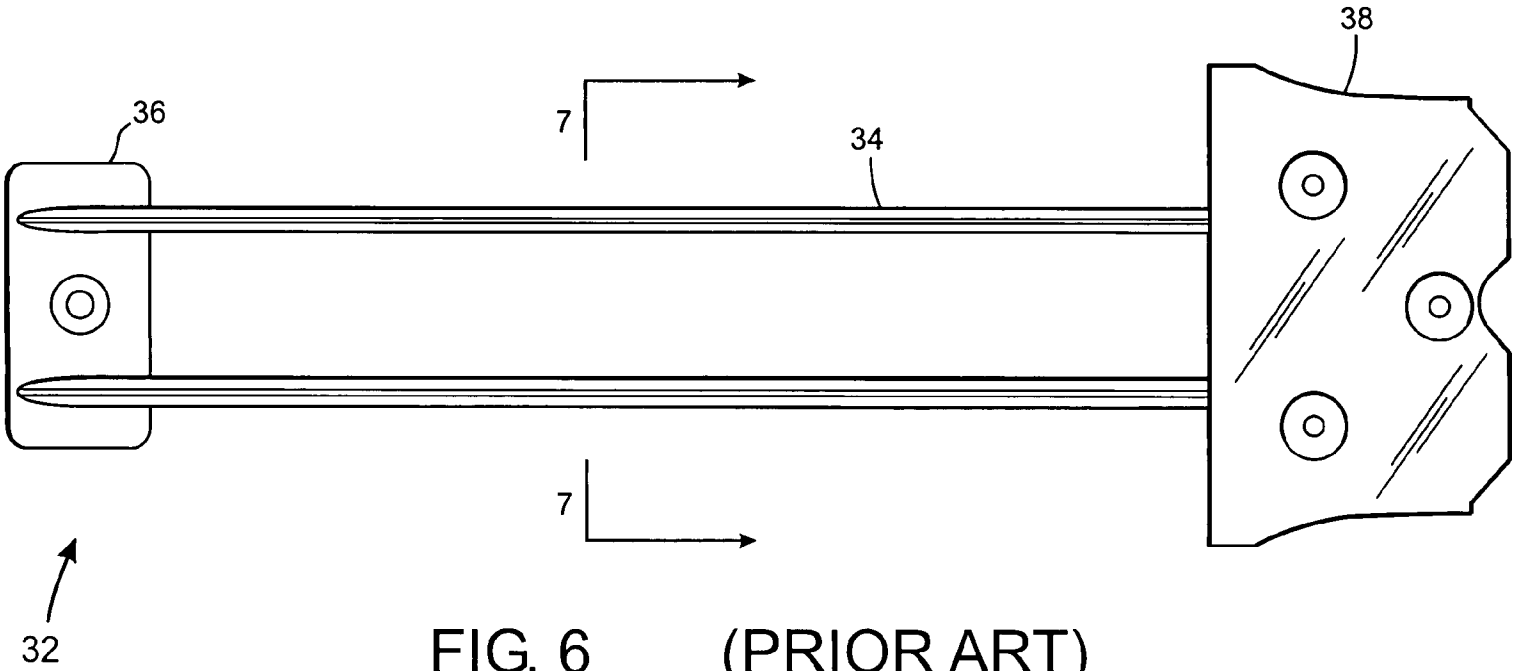
FIG. 6 (PRIOR ART)
FIG. 6 is a bottom plan view of an intake guard of the type known in the art and configured for attachment to a water intake port of a stock jet watercraft.
Figure 7:
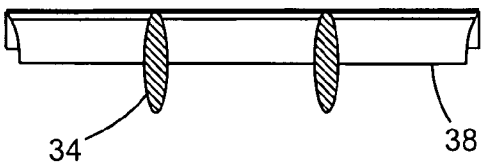
FIG. 7 (PRIOR ART)
FIG. 7 is a cross sectional view of an intake guard taken along line 7-7 in FIG. 6 illustrating a pair of extended finned members.

As illustrated in FIGS. 3 and 5, the water intake port 12 present in a stock jet watercraft is typically located about an underside portion 28 of a jet watercraft's hull 30, approximately one-third distance from the rear side 18 of the jet watercraft. In stock jet watercraft configurations, the water intake port is preferentially fitted with a factory-installed intake guard 32, typically of the type shown in FIGS. 6 and 7 to comprise a pair of extended finned members 34 situated in between and having ends connected to fore and aft stock mounts 36, 38. The fore and aft stock mounts of the type configured for jet watercraft 14 in particular may include a number of design configurations to further adapt to the unique design characteristics and structural features of the water intake port incorporated and inherently included in many of today's jet watercraft, such as those manufactured and made available by Kawasaki Corporation and Suzuki Corporation, both of Japan.

Figure 4:
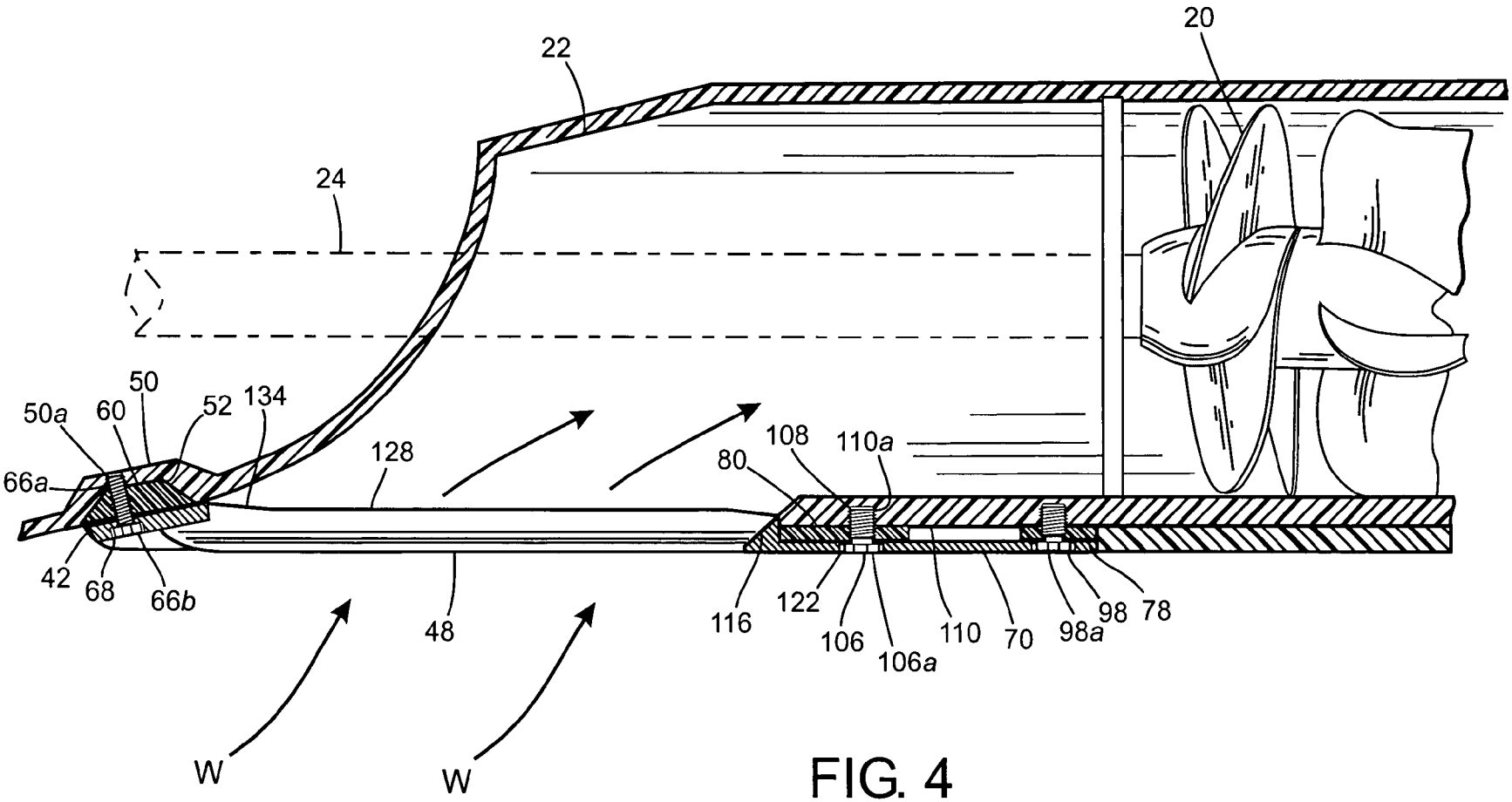
FIG. 4 is a partial cross sectional view of a water intake port of a stock jet watercraft equipped with a water intake grill of the present invention and a mixed flow impeller of the type associated with the jet watercraft.
Figure 8:
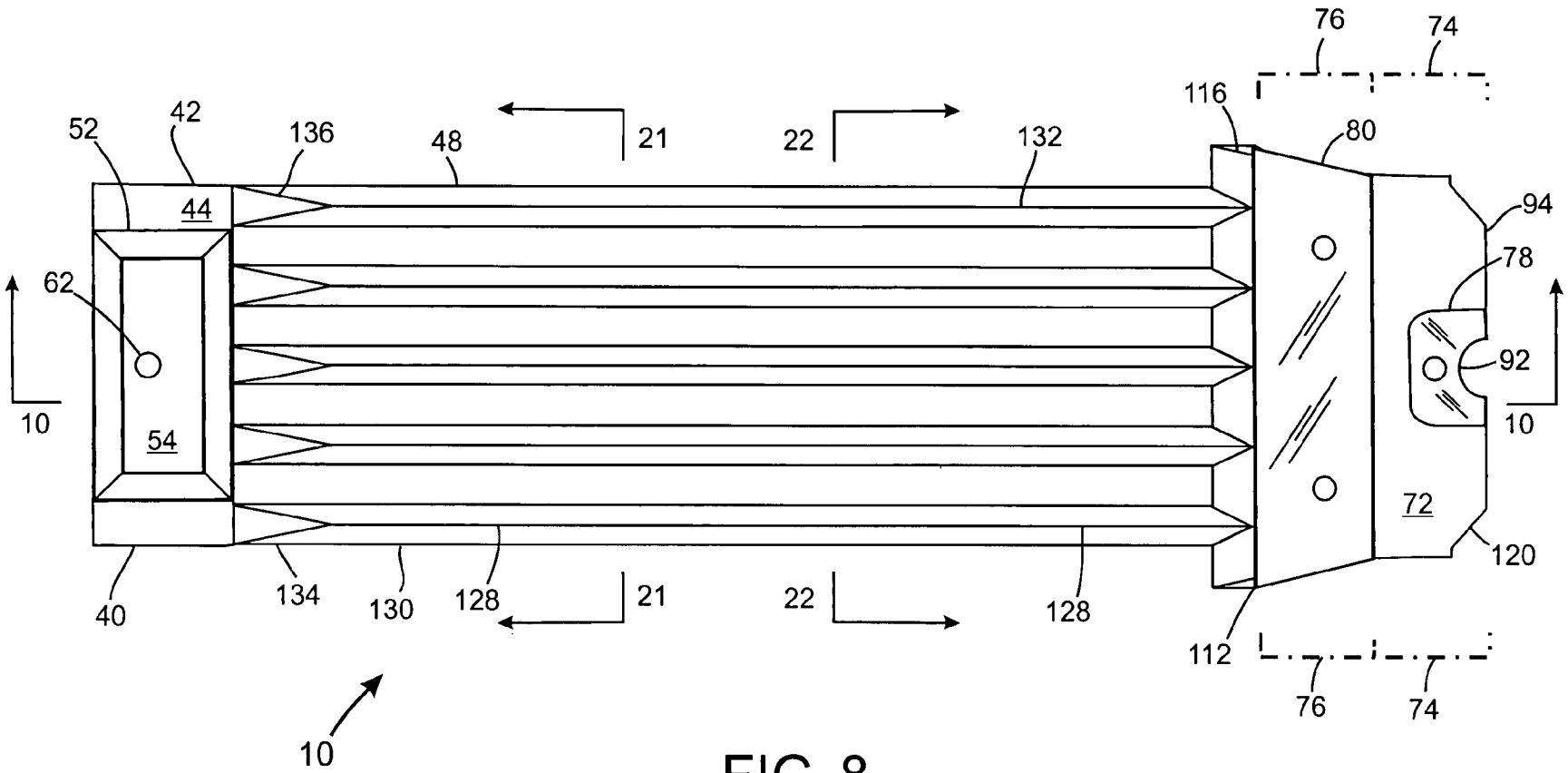
FIG. 8 is a top plan view of the preferred embodiment of the present invention illustrating a plurality of elongate members situated in between and connected to fore and aft mounts.
Figure 9:
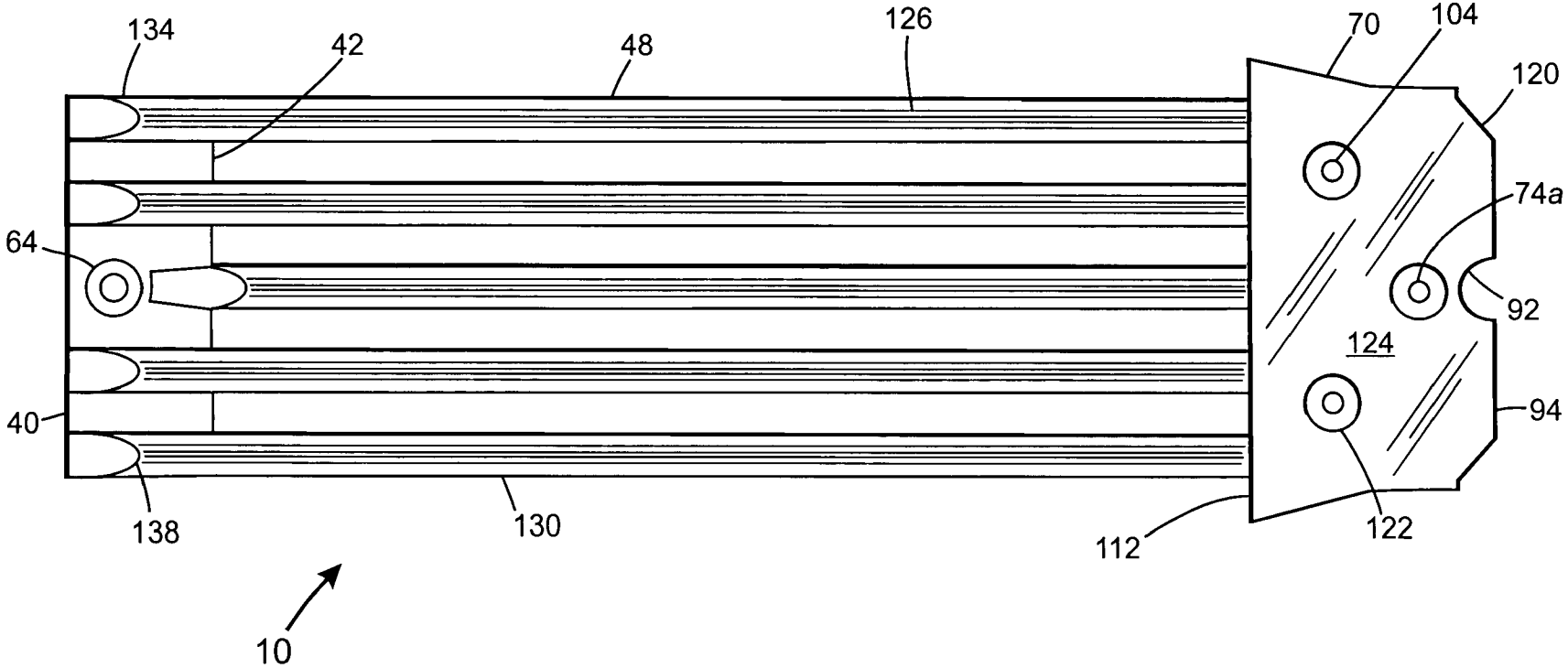
FIG. 9 is a bottom plan view of the preferred embodiment of the present invention illustrating a plurality of elongate members situated in between and connected to fore and aft mounts.
Figure 10:
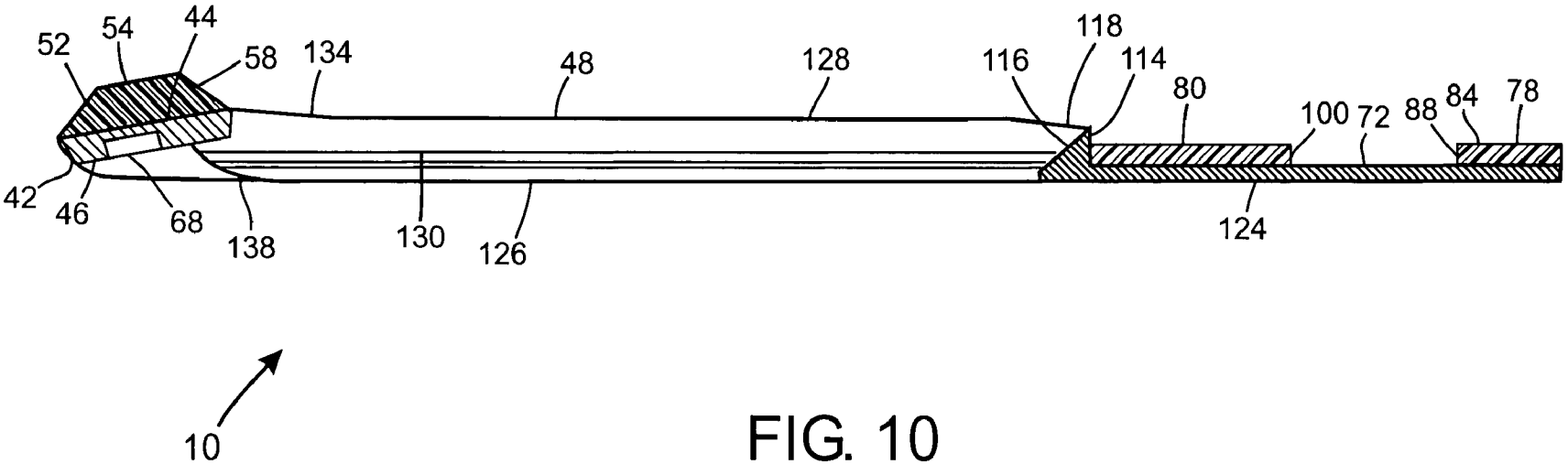
FIG. 10 is a cross sectional view of the preferred embodiment of the present invention taken along line 10-10 in FIG. 8 illustrating a removable key element resting atop a fore mount and first and second removable spacers resting atop an aft mount.
Figure 11:
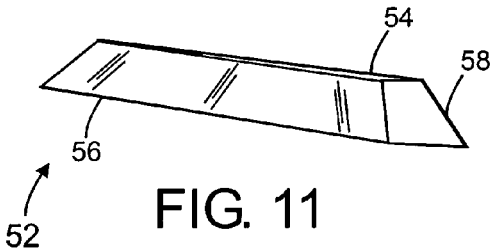
FIG. 11 is a perspective view of the preferred embodiment of the present invention illustrating a removable key element.
Figure 12:
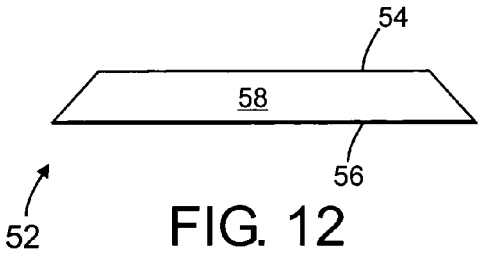
FIG. 12 is a side elevational view of the preferred embodiment of the present invention illustrating a removable key element.
Figure 13:
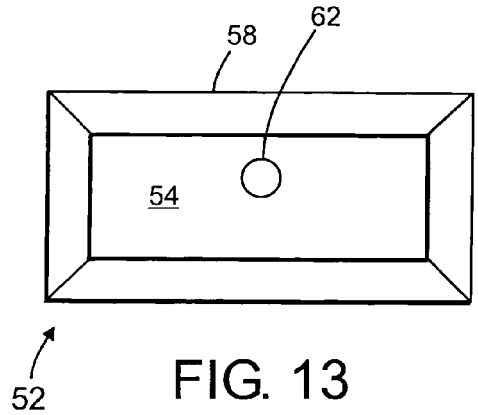
FIG. 13 is a top plan view of the preferred embodiment of the present invention illustrating a removable key element.

A fore mount 40 of the present invention, as illustration in FIGS. 8 and 9, incorporates a base 42 having angularly orientated top and bottom surfaces 44, 46 in relation to a plurality of elongate members 48, preferentially coinciding with the positional or angular orientation of a forward wall section 50 of the water intake port 12 shown in FIG. 4. Optionally fitted atop the angularly orientated top surface 44, as illustrated in FIGS. 8 and 10, is at least one removable key element 52 preferably comprising top and bottom facing sides 54, 56 integrally connected by pitched sides 58 to form an overall geometric structure substantially coinciding with the geometric configuration of a mount socket 60 integral to the forward wall section 50 of the water intake port. It is expressly noted herein that the removable key element 52 as represented in FIGS. 11-13 may comprise alternative geometric configurations other than the one previously described, preferably to the extent that it corresponds to the geometric confines and shape of the mount socket 60 of the forward wall section to ensure correct orientation of the fore mount 40 and consequentially the water intake grill 10 within the structural configuration of the water intake port 12. Extending through the removable key element 52 is at least one aperture 62 configured to align with an equal number of apertures 64 extending through the base, primarily for which is suited to accept therethrough a mount bolt 66 or an equivalent type of fastener. The mount bolt in this strict application, as shown in FIG. 4, comprises a threaded end 66*a* for threadably engaging a threaded aperture 50*a* integral to the forward wall section 50, sufficiently of which serves to simultaneously retain the position of the removable key element 52 and tightly secure the fore mount of the water intake grill 10 to the water intake port. The base's aperture, as shown in FIGS. 9 and 10, may be further associated with a circular recess 68 inwardly extending partway into the angularly orientated bottom surface 46 of the base to conceal a head portion 66*b* of the mount bolt to further streamline the appearance of and permit unobstructive water flow over and around the water intake grill 10 while attached to the jet watercraft.

Referring now to FIG. 8, an aft mount 70 of the present invention is preferably shown to comprise a horizontally positioned base 72 generally divided into rearward and forward sections 74, 76 (as shown by bounded lines), each sufficing as a location to optionally accept and mount thereon first and second removable spacers 78, 80, respectively. The first and second removable spacers of the type shown in FIGS. 14-19 functionally serve to upwardly suspend the aft mount of the water intake grill 10 within a mount socket 82 present in the rearward wall section to the extent that it corresponds to the level of the underside portion 28 of a jet watercraft's hull 30, purposefully to mitigate a condition of turbulent water flow thereover that can adversely affect jet watercraft operation and performance.

Figure 14:
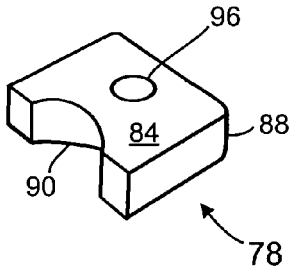
FIG. 14 is a perspective view of the preferred embodiment of the present invention illustrating a first removable spacer.
Figure 15:
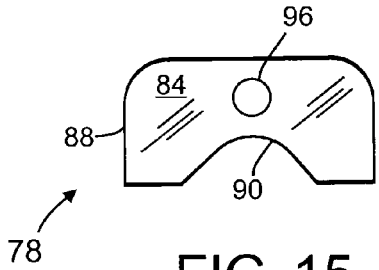
FIG. 15 is a top plan view of the preferred embodiment of the present invention illustrating a first removable spacer.
Figure 16:
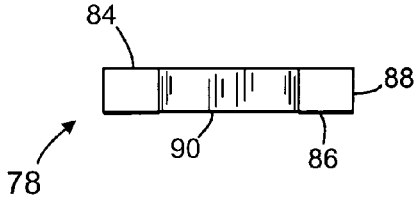
FIG. 16 is a side elevational view of the preferred embodiment of the present invention illustrating a first removable spacer.
Figure 17:
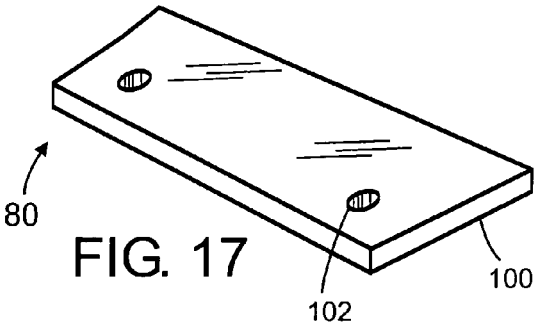
FIG. 17 is a perspective view of the preferred embodiment of the present invention illustrating a second removable spacer.
Figure 18:
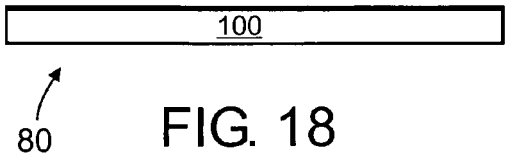
FIG. 18 is a side elevational view of the preferred embodiment of the present invention illustrating a second removable spacer.
Figure 19:
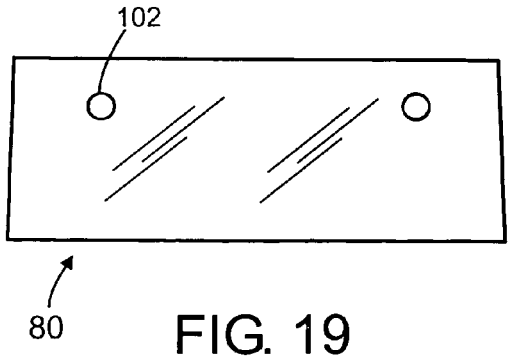
FIG. 19 is a top plan view of the preferred embodiment of the present invention illustrating a second removable spacer.

The first removable spacer 78, as particularly shown in FIGS. 14-16, is generally associated with top and bottom surfaces 84, 86 integrally connected by a perpendicular wall 88. As shown in FIG. 14, the first removable spacer may be distinctly associated with an integrally formed semi-circular notch 90 that substantially corresponds upon its placement with an equally configured notch 92 positioned along an outward edge 94 of the rearward section. Preferably, at least one aperture 96 extends through the first removable spacer and aligns with an equal number apertures 74*a* passing through the rearward section of the horizontally positioned base 72, substantially to the extent of receiving therethrough a mount bolt 98 or an equivalent type of fastener.

Referring now to FIG. 8, the forward section 76 is generally defined as occupying approximately one-half of the surficial area of the horizontally positioned base 72 for which is suited to optionally accept and mount thereon the second removable spacer 80. The second removable spacer is preferentially shown in FIG. 20 to extend the approximate width of the aft mount 70 and comprise a peripheral wall 100 with a height substantially equivalent to that of the first removable spacer 78. At least one aperture 102 extends through the second removable spacer and aligns with an equal number of apertures 104 extending through the forward section. Like the rearward section, a mount bolt 106 or an equivalent fastener type supplementally serves to secure the forward section of the aft mount 70 to the water intake port 12, primarily by means of its insertion through the aligned apertures 102, 104 and its threaded end 108 being threadably engaged with a threaded aperture 110*a* present in a rearward wall section 110 of the water intake port.

As depicted in FIG. 10, the forward section 76 of the horizontally positioned base 72 is further associated along an outward edge 112 thereof with an elevated back edge 114 and an angular edge 116 integrally connected thereto for receiving and attaching second ends 118 of the elongate members 48. The resultant configuration of the elevated back edge along with the removable spacers optionally placed upon the horizontally positioned base 72 sets forth a condition of allowing the aft mount 70 to further coincide with the geometric configuration of the mount socket 82 of the rearward wall section of the water intake port 12 and reside in a level relationship relatively to the underside portion 28 of a jet watercraft's hull 30, as generally represented in FIG. 4.

Figure 20:
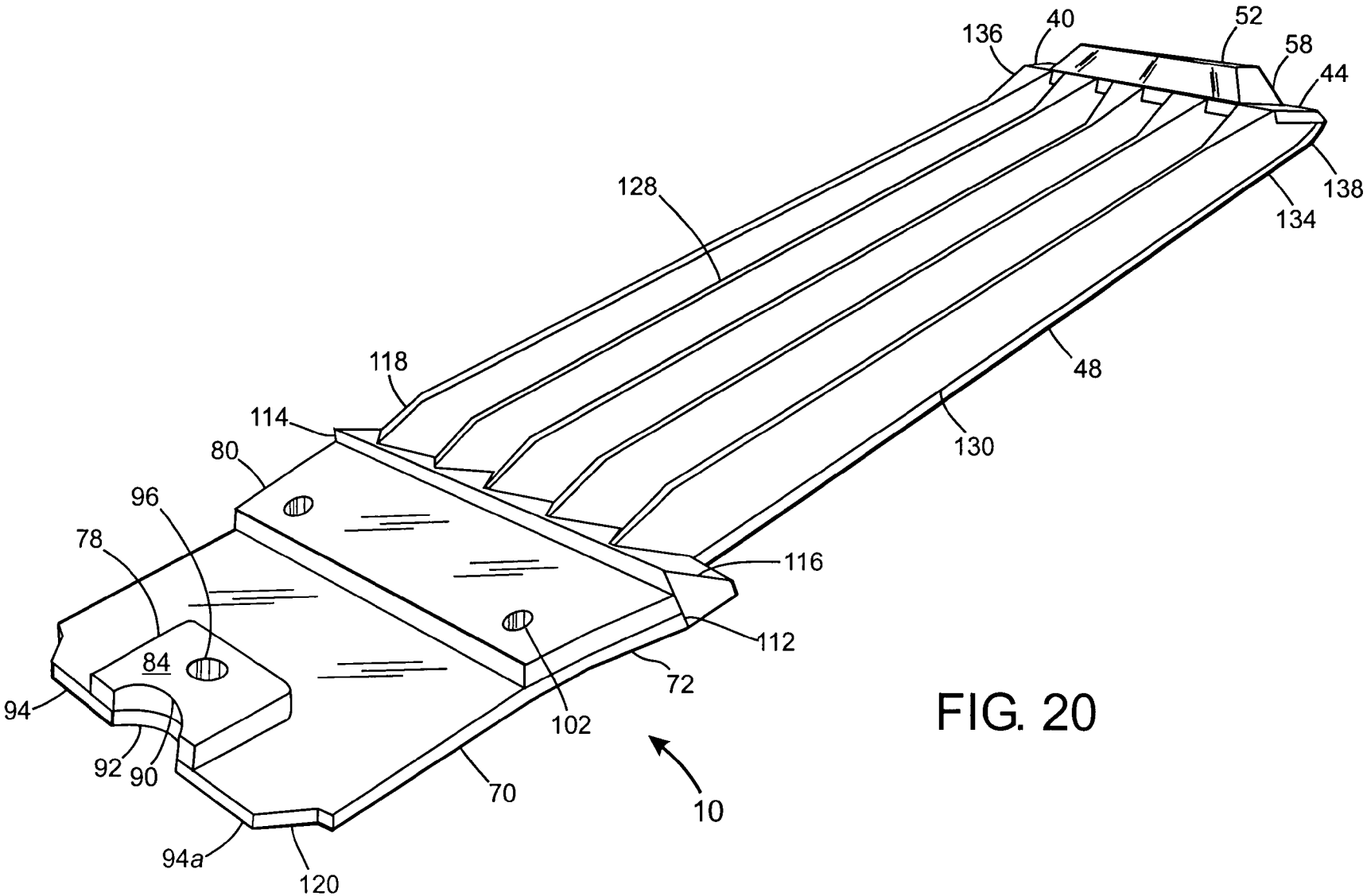
FIG. 20 is a perspective view of the preferred embodiment of the present invention illustrating a plurality of elongate members situated in between and connected to fore and aft mounts and a removable key element resting atop the fore mount and first and second removable spacers resting atop the aft mount.

In supplementing the lateral fit of the aft mount 70 to that of the water intake port, a pair of angular notched corners 120 of the form depicted in FIG. 20 may be included at two opposing ends 94*a* of the outward edge 94 of the rearward section of the horizontally positioned base 72, preferably being placed in proximity to the location of the first removable spacer 78. Like the angularly orientated bottom surface 46 described above, each of the apertures of the rearward and forward sections is generally associated with a circular recess 122 inwardly extending into an outward back surface 124 of the horizontally positioned base to conceal a head portion 98*a*, 106*a* of each mount bolt 98, 106, purposefully to facilitate a streamlined appearance of and permit unobstructed water flow over and around the water intake grill 10 while it is mounted to the water intake port 12.

It is worthy to note that the fore and aft mounts 40, 70 described above and elsewhere may eliminate or comprise one or a plurality of removable spacers each of which sufficiently serving to correctly position and permit secure attachment of the water intake grill to the water intake port. The number and configuration of each removable spacer optionally associated with any one, overall configuration of the water intake grill largely depends on the manufacturer's layout and mount socket configuration of the water intake port. For this reason, the aft and fore mounts integrated into the water intake grill 10 of the present invention is not to be construed as a strict limitation to the specific embodiment described herein; alternative configurations or pattern layouts of the removable spacers or even none at all is further contemplated herein. In the instance of eliminating the presence of removable spacers 78, 80, it is further contemplated that the aft mount may be appropriately sized or thickened in construction to the extent that the outward back surface 124 thereof relatively resides in a flush position with respect to the underside portion 28 of a jet watercraft's hull 30 to minimize a condition of turbulent water flow over the water intake grill. However, this may unnecessarily increase the overall weight of the water intake grill, making it less desirable to the enthusiast seeking a less-weighted jet watercraft to gain utmost performance therefrom.

Figure 21:
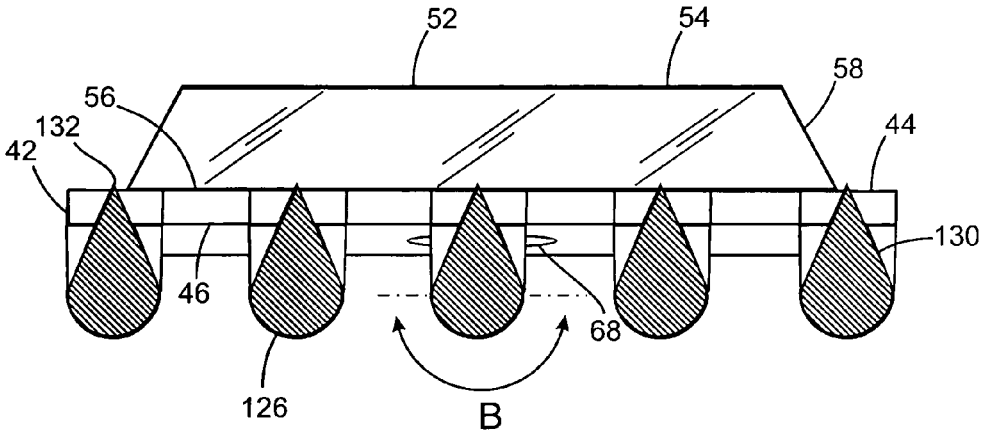
FIG. 21 is a cross sectional view of the preferred embodiment of the present invention taken along line 21-21 in FIG. 8 illustrating a plurality of elongate members and a removable key element resting atop a fore mount.
Figure 22:
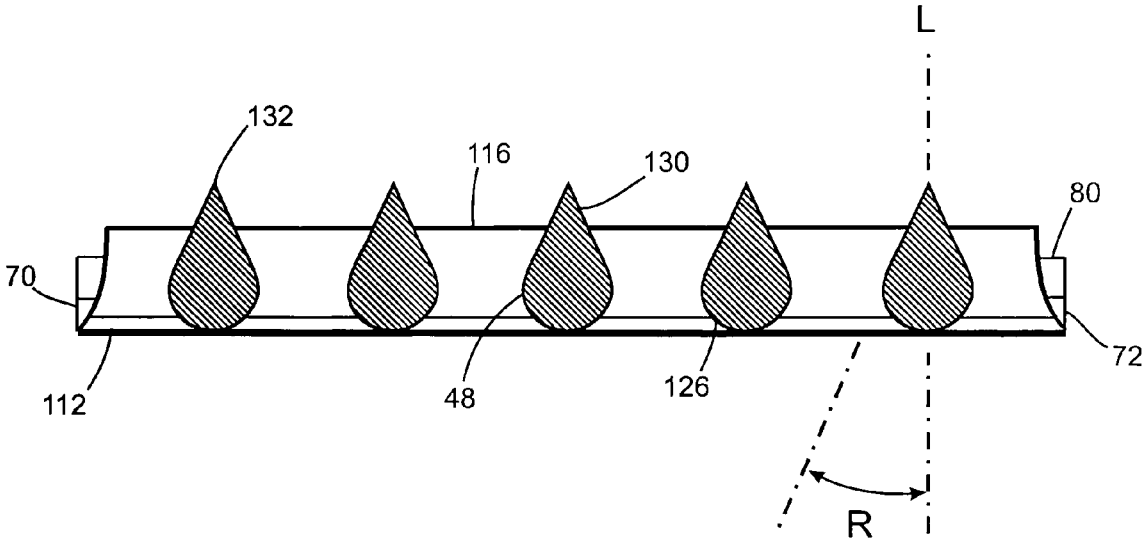
FIG. 22 is a cross sectional view of the preferred embodiment of the present invention taken along line 22-22 in FIG. 8 illustrating a plurality of elongate members integrally connected to an angular edge of an aft mount.
Figure 23:
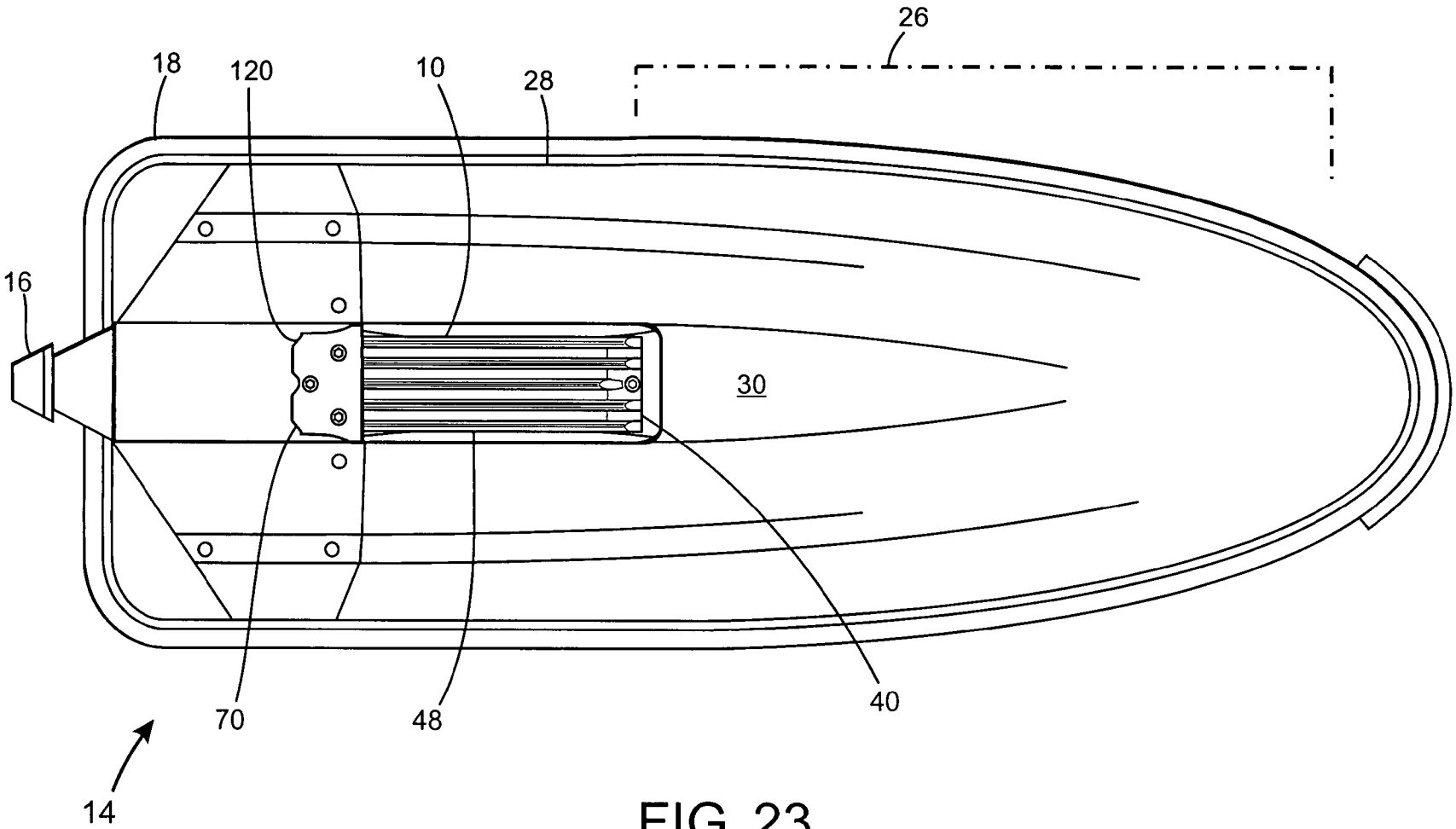
FIG. 23 is a bottom plan view of a hull of a stock jet watercraft equipped with a water intake grill of the present invention, specifically being mounted over a water intake port of the jet watercraft.

Referring now to FIGS. 21 and 22, each elongate member 48 of the water intake grill comprises a teardrop geometric profile or a profile resembling an airfoil of an airplane's wing to permit or promote a condition of laminar water flow over the set of elongate members 50 while restricting the passage of most debris and foreign matter that may hamper engine performance of the jet watercraft 14, as previously discussed elsewhere herein. A plurality of lines designated as W in FIG. 4 indicates the direction of water flow to establish this preferred laminar condition. A cross sectional view of the elongate member, as depicted in FIG. 21, reveals an outward bottom section 126 having a general rounded appearance, a configuration of which primarily functions to shed away debris and lessen the accumulation of debris at the water intake port 12 insofar to permit continued passage of water into the water intake port for sustained engine performance. Arc B in FIG. 21 defines the extent for which the outward bottom section 126 of the elongate member is considered as having a preferred rounded appearance. As illustrated in FIG. 22, each elongate member 48 is further associated with a tapered top end 128 having sides 130 commencing from an apex 132 and extending angularly outward toward the outward bottom section. In the preferred embodiment of the water intake grill 10, an angular orientation R of 25 degrees establishes the angular extent to which the sides 130 are positioned relative to axis L shown in FIG. 22. A minimum intake opening of at least ⅜ inch, as shown in FIG. 23, is held in between each of the elongate members 48 and adjacent sidewalls 12*a* of the water intake port 12, preferentially of which establishes a reduction of passing debris into the water intake port while permitting a sufficient water flow through the water intake grill 10 and into the water intake port to yield sustained cooling of the combustion engine and maintain efficient performance of the propulsion system of the jet watercraft.

Further shown in FIGS. 8 and 20, a first end 134 of the elongate member preferably comprises a splayed outward portion 136 to strengthen and enhance the structural integrity of the connection in between the elongate member 48 and fore mount's base 42 and allow the first end thereof to transitionally meet the position of the angularly orientated top surface 44. An integral elbow 138 of the preferred type illustrated in FIG. 1 is generally associated with the first end of each elongate member to further streamline the appearance of the set of elongate members 48 while attached to the fore mount 40 and provide for a condition of laminar water flow over the water intake grill 10 and the boat's hull 30 during operation of the jet watercraft 14 in a body of water.

It can be seen from the foregoing that there is provided in accordance with this invention a simple and easily operated device, which is particularly suited for attachment to a water intake port 12 of a jet watercraft 14 of the type noted in the art to carry and transport one or more persons over a surface of a body of water. Prolonged testing of the water intake grill 10 reveals improved performance of the jet watercraft over the intake guard 32 in stock arrangements, primarily due to its effectiveness in shedding away and mitigating entry of waterborne debris such as suspended weeds and rocks of moderate to large size into the water intake port of the jet watercraft. Through the reduction and even elimination of such debris from the water intake port, sustained cooling of the combustion engine and reduced damage to the mixed flow impeller 20 and associated operable components are appreciably apparent to the extent of permitting relied operation and performance of the jet watercraft as configured and designed by the manufacturer.

It is obvious that the components comprising the water intake grill may be fabricated from a variety of materials, providing such selection or use of materials possess the capacity to withstand forces acting thereon throughout its duration of use on a jet watercraft. Accordingly, it is most desirable, and therefore preferred, to construct the water intake grill 10 from steel coated with a polymeric or epoxy paint or equivalent, stainless steel, aluminum, or an equivalent type of material capable of preventing premature corrosion of the substrate while in the presence of a fresh or salt water environment. To lessen the cost and simplify construction of the water intake grill and increase its overall structural integrity, the fore and aft mounts 40, 70 as well as the set of elongate members 48 are preferably fabricated as a unified structure, typically by means of cast molding or an equivalent form of technology. Likewise, the removable key element 52 and removable spacers 78, 80 described herein may be fabricated from equivalent corrosive materials noted above or alternatively from a durable, high-density plastic material.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A water intake grill for attachment to a water intake port having a pair of sidewalls and forward and rearward wall sections each having at least one mount socket, said intake grill comprising, in combination:

a fore mount having a base with angularly orientated top and bottom surfaces substantially coinciding with the positional orientation of the forward wall section;

an aft mount having a horizontally positioned base with a top planar surface and rearward and forward sections substantially coinciding with the positional orientation of the rearward wall section;

means for anchoring said fore and aft mounts to the forward and rearward wall sections of water intake port, respectively; and a plurality of elongate members each having first and second ends and a teardrop geometric profile incorporating a tapered top end and an outward bottom section having a general rounded appearance, said first and second ends of each elongate member being integrally connected to said angularly orientated bottom surface of base and to said forward section of aft mount, respectively, said tapered top end of elongate member having an apex and a pair of sides each commencing from said apex and extending angularly outward a predetermined amount from a longitudinal axis extending through said apex and said outward bottom section.

2. An intake grill as set forth in claim 1, wherein said fore and aft mounts each comprise at least one aperture extending therethrough to receive said anchoring means.

3. An intake grill as set forth in claim 2, wherein said anchoring means comprises a mount bolt passing through each of said apertures of fore and aft mounts and having a threaded end threadably engaging a threaded aperture integrally included in each of the forward and rearward wall sections of water intake port.

4. An intake grill as set forth in claim 2, wherein said fore mount supplementally comprises at least one removable key element situated atop of said angularly orientated top surface.

5. An intake grill as set forth in claim 4, wherein said removable key element comprises top and bottom facing sides integrally joined by pitched sides collectively forming a unified, geometric structure substantially conforming to the geometric configuration of the mount socket of forward wall section.

6. An intake grill as set forth in claim 5, wherein said removable key element comprises apertures equal in number and aligned with said apertures present in said fore mount, said bottom facing side being selectively orientated to engage and rest atop said angularly orientated top surface of base.

7. An intake grill as set forth in claim 1, wherein said aft mount supplementally comprises at least one removable spacer situated atop of said top planar surface of horizontally positioned base.

8. An intake grill as set forth in claim 7, wherein said removable spacer comprises top and bottom surfaces integrally joined by a perpendicular wall and an integrally formed semi-circular notch substantially corresponding with an equally configured notch positioned along an outward edge of rearward section.

9. An intake grill as set forth in claim 1, wherein said rearward section of horizontally positioned base comprises a pair angular notched corners.

10. An intake grill as set forth in claim 1, wherein said first end of elongate member comprises a splayed outward portion to strengthen the connection thereat and an integral elbow to minimize its obstructiveness.

11. An intake grill as set forth in claim 2, wherein said rearward and forward sections of aft mount each comprise at least one removable spacer resting atop said top planar surface of horizontally positioned base and having apertures equal in number and aligned with said apertures present in said aft mount for receiving therethrough said anchoring means, said forward section comprising along an outward edge thereof an angular edge for receiving and attaching said second ends of elongate members and an elevated back edge integrally connected and positioned parallel thereto.

12. An intake grill as set forth in claim 1, wherein each of said sides of tapered top end extends angularly outward 25 degrees from a longitudinal axis extending through said apex and said outward bottom section.

13. An intake grill as set forth in claim 1, wherein said elongate members are held apart from one another and sidewalls of water intake port to form thereinbetween a minimum intake opening of at least ⅜ inch.

14. A water intake grill for attachment to a water intake port having a pair of sidewalls and forward and rearward wall sections each having at least one mount socket integral thereto, said intake grill comprising, in combination:

a fore mount having a base with angularly orientated top and bottom surfaces substantially coinciding with the positional orientation of the forward wall section and at least one aperture extending therethrough for accepting a mount bolt for attaching said fore mount to forward wall section, said angularly orientated top surface supplementally having at least one removable key element engaging and resting atop thereof;

an aft mount having a horizontally positioned base substantially coinciding with the positional orientation of the rearward wall section and at least one aperture extending therethrough for accepting a mount bolt for attaching said aft mount to rearward wall section, said horizontally positioned base supplementally having at least one removable spacer engaging and resting atop thereof and an angular edge integrally connected to an elevated back edge; and a plurality of elongate members each having first and second ends and a teardrop geometric profile incorporating a tapered top end and an outward bottom section having a general rounded appearance, said first end being integrally connected to said angularly orientated bottom surface of base and said second end being integrally connected to said angular edge.

15. An intake grill as set forth in claim 14, wherein said removable key element comprises top and bottom facing sides integrally joined by pitched sides collectively forming a unified, geometric structure substantially conforming to the geometric configuration of the mount socket of forward wall section.

16. An intake grill as set forth in claim 14, wherein said elongate members are held apart from one another and sidewalls of water intake port to form thereinbetween a minimum intake opening of at least ⅜ inch, said tapered top end of elongate member comprising an apex and a pair of sides each commencing from said apex and extending angularly outward 25 degrees from a longitudinal axis extending through said apex and said outward bottom section.

17. A water intake grill for attachment to a water intake port having a pair of sidewalls and forward and rearward wall sections each having at least one mount socket integral thereto, said intake grill comprising, in combination:

a fore mount having a base with angularly orientated top and bottom surfaces substantially coinciding with the positional orientation of the forward wall section and at least one aperture extending therethrough for accepting a mount bolt for attaching said fore mount to forward wall section, said angularly orientated top surface supplementally having at least one removable key element engaging and resting atop thereof;

an aft mount having a horizontally positioned base substantially coinciding with the positional orientation of the rearward wall section, said horizontally positioned base supplementally having first and second removable spacers each engaging and resting atop thereof and an angular edge integrally connected to an elevated back edge; and a plurality of elongate members each having first and second ends and a teardrop geometric profile incorporating a tapered top end and an outward bottom section having a general rounded appearance, said first end being integrally connected to said angularly orientated bottom surface of base and having a splayed outward portion to strengthen the connection thereat and transitionally meet said angularly orientated top surface and an integral elbow to minimize the obstructiveness of said elongate member, said second end being integrally connected to said angular edge.

18. An intake grill as set forth in claim 17, wherein said elongate members are held apart from one another and sidewalls of water intake port to form thereinbetween a minimum intake opening of at least ⅜ inch.

19. An intake grill as set forth in claim 17, wherein said tapered top end of elongate member comprises an apex and a pair of sides each commencing from said apex and extending angularly outward 25 degrees from a longitudinal axis extending through said apex and said outward bottom section.

20. An intake grill as set forth in claim 17, wherein said horizontally positioned base comprises rearward and forward sections each comprising at least one aperture extending therethrough for accepting a mount bolt for attaching said aft mount to rearward wall section, said rearward section comprising an outward edge integrally configured with a notch and a pair of angular notched corners, said first removable spacer being placed upon said rearward section and comprising at least one aperture extending therethrough to align with said aperture of rearward section and top and bottom surfaces integrally joined by a perpendicular wall and an integrally formed semi-circular notch substantially corresponding with said notch of outward edge, said second removable spacer being placed upon said forward section and comprising at least one aperture extending therethrough to align with said aperture of forward section and a peripheral wall having a height substantially corresponding to said perpendicular wall.

* * * * *